US008739868B2

(12) United States Patent
Zeineddine

(10) Patent No.: US 8,739,868 B2
(45) Date of Patent: Jun. 3, 2014

(54) SYSTEM AND METHOD OF STRAIN MEASUREMENT AMPLIFICATION

(75) Inventor: Firas Zeineddine, Bristol (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 585 days.

(21) Appl. No.: 12/955,572

(22) Filed: Nov. 29, 2010

(65) Prior Publication Data

US 2012/0132467 A1 May 31, 2012

(51) Int. Cl.
*G01B 7/16* (2006.01)

(52) U.S. Cl.
USPC ..... 166/250.01; 73/782; 175/40

(58) Field of Classification Search
USPC ..... 166/66, 250.01; 175/40; 73/774, 775, 73/781, 782, 862.621, 862.632, 862.633, 73/862.636, 862.637, 862.638
See application file for complete search history.

(56) References Cited

U.S. PATENT DOCUMENTS

| | | | | |
|---|---|---|---|---|
| 2,897,672 | A * | 8/1959 | Glasbrenner et al. | 73/861.72 |
| 3,599,479 | A * | 8/1971 | Kutsay | 73/781 |
| 3,658,138 | A * | 4/1972 | Gosselin | 173/1 |
| 4,811,597 | A | 3/1989 | Hebel | |
| 5,313,023 | A | 5/1994 | Johnson | |
| 5,872,319 | A | 2/1999 | Bruns et al. | |
| 6,684,949 | B1 | 2/2004 | Gabler et al. | |
| 6,766,701 | B2 | 7/2004 | Norling et al. | |
| 6,888,074 | B2 | 5/2005 | Haggstrom | |
| 2008/0034883 | A1 * | 2/2008 | Majeti | 73/780 |
| 2009/0139342 | A1 * | 6/2009 | Robert et al. | 73/818 |

FOREIGN PATENT DOCUMENTS

EP 1380823 A2 1/2004

OTHER PUBLICATIONS

Search Report dated Jan. 3, 2012 for corresponding GB Application No. 1120257.9.

* cited by examiner

*Primary Examiner* — David Andrews
*Assistant Examiner* — Ronald Runyan
(74) *Attorney, Agent, or Firm* — Chadwick A. Sullivan; Brigitte Echols

(57) ABSTRACT

A technique physically amplifies strain to facilitate measurement of strain/displacement. A strain amplifying mechanism is mounted to a component being monitored for strain and comprises an input port and an output port. The strain amplifying mechanism is attached to the component such that the input port moves when the component undergoes strain. Movement of the input port causes movement of the output port over a distance greater than the physical movement of the input port. A strain sensor is coupled to the output port to detect its movement over the greater distance.

19 Claims, 5 Drawing Sheets

SYSTEM AND METHOD OF STRAIN MEASUREMENT AMPLIFICATION

BACKGROUND

Measuring stress and strain can be extremely difficult and often requires use of sensitive equipment able to measure very small values of strain. Generally, direct stress measurement methods are not available for commercial applications and thus stress generally is determined by measuring strain. Several types of sensors are employed for measuring strain and include strain gauges, e.g. piezo-resistive strain gauges, magnetoelastic devices, optical sensors, acoustic sensing devices, eddy current devices, rings under load, load cells, and diaphragms. However, existing strain gauges and other strain measurement sensors are extremely sensitive to external conditions such as drift (permanent movement of the sensor after strains occur), residual stresses or strains, temperature effects, electric noise, other environmental factors, and/or defective mechanical bonding of the sensor to the material being tested for strain. Accordingly, measuring strain accurately is difficult in downhole applications, such as wellbore drilling applications.

Various approaches have been employed to correct for these conditions. For example, signal amplification devices, e.g. operation amplifiers, may be employed; or the sensitivity of the gauge may be electrically increased through the use of Wheatstone bridges. However, even with such enhancements the signal of the strain gauge remains low and is susceptible to environmental effects and other limiting effects. In some applications, the effects of changes in temperature have been compensated to some extent by selecting a sensor material and a backing material having a thermal expansion coefficient similar to that of the reference material of the object being monitored for strain. This technique reduces the effect of temperature but does not eliminate the effect. In a downhole drilling application, for example, the temperature on a drilling collar can change 150° C. which causes an expansion of the collar about 25 times greater than the strain induced due to drilling loads. This means that if the error in temperature measurement is 1%, the error in strain measurement can readily reach 20%.

Other methods employed to compensate for temperature changes include placement of temperature compensating measuring devices in a Wheatstone bridge. Look-up tables or polynomial fitting also can be employed to model the effect of temperature on the strain measurements, and sometimes temperature effects can be compensated via software. However, existing approaches are not able to sufficiently compensate for the many environmental factors and other effects encountered in relatively extreme applications to provide accurate and consistent strain measurements.

SUMMARY

In general, a system and methodology is provided to mechanically or physically amplify strain, and thereby to facilitate measurement of strain and/or to enable measurement of displacement, instead of simply boosting the sensor signal. A strain amplifying mechanism is mounted to a component being monitored for strain and comprises an input port and an output port. The strain amplifying mechanism is attached to the component such that the input port moves when the component undergoes strain. Movement of the input port causes movement of the output port over a distance greater than the physical movement of the input port. A sensor, e.g. a strain sensor or a displacement sensor, is coupled to the output port to detect its movement over the greater distance.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
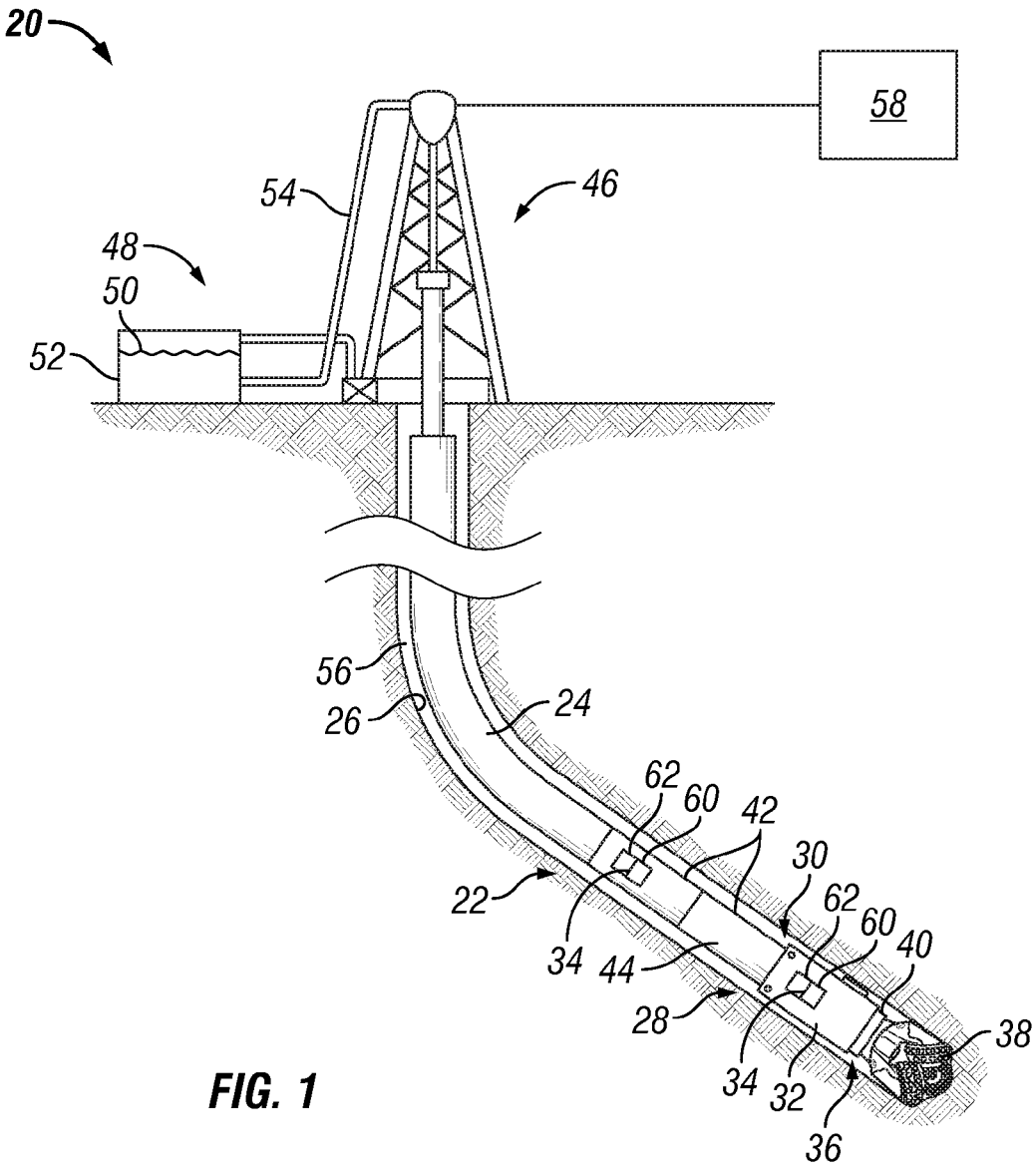
FIG. 1 is a schematic illustration of an example of a drill string which includes a component being monitored for strain, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The embodiments described herein generally relate to a system and method for providing improved strain/displacement measurements in a variety of environments. The technique mechanically or physically increases the strain or displacement measured by a corresponding sensor to enable easier and more consistent detection and monitoring of the strain or deformation experienced by a component. By mechanically increasing the strain, the sensors need not rely solely on boosting of the signal but are instead able to measure an actual, physical movement. The actual, physical movement detected by the sensor occurs over a greater distance than the movement associated directly with the strain experienced by the component if measured over the same reference length. The "boosted" mechanical strain facilitates detection and monitoring of strain in difficult environments, such as harsh environments and environments having substantial electrical noise. As a result, the system and method are suitable to a variety of downhole well applications, such as wellbore drilling applications. By more accurately measuring strain in these types of applications, failures and/or expensive delays can be minimized. For example, accurate measurement of tensile/torsion forces can help optimize well operations, avoid destructive events during the operation (e.g. over pull, over torque, buckling), and minimize indeterminist failure, (e.g. fatigue of drill collars or excessive drill bit wear).

According to one embodiment, a method for measuring strain employs one or more compliant mechanisms which are able to amplify the strain experienced by a corresponding component subjected to loading. This allows the strain sensors to read a larger response which leads to a more accurate reading because the signal-to-noise ratio is greatly reduced. Each compliant mechanism has at least one input port and at least one output port. The input port is a portion of the compliant mechanism directly linked with a reference structure so as to move under the input of strain occurring in the reference structure. Once the input port moves due to deformation of the reference structure, the output port deforms with a larger value, e.g. moves over a greater distance, than the input port.

The value of the output deformation relative to the input deformation can be determined via kinematic calculations. Consequently, the output can be optimized for a certain input range and dynamic response. A sensing device is coupled with the output port to measure the amplified strain, and the sensing device may comprise a variety of strain gauges or other sensors designed to measure the output deformation.

Depending on the environment and application, strain measurement systems may be constructed with various types of mechanical strain amplifying mechanisms, including compliant mechanisms. Compliant mechanisms are mechanical devices which provide smooth and controlled motion guidance due to deformation of some or all of the components/features of the compliant mechanism. Compliant mechanisms may be multi-piece devices or monolithic (single-piece) devices. Compliant mechanisms do not require sliding, rolling or other types of contact bearings often found in rigid mechanisms. For example, some compliant mechanisms are formed with living or live hinges instead of revolute-joint mechanisms (mechanisms in which one feature pivots or otherwise slides with respect to another feature of the mechanism). Use of compliant mechanisms in strain sensor systems, such as those described below, enable the sensor systems to achieve reliable, high-performance motion measurement which, in turn, enables reliable, high-performance motion control at low cost. As described below, various embodiments of the compliant mechanisms may be designed as micro-electromechanical systems.

Referring generally to FIG. 1, a system 20 is illustrated as an example of a type of system having components subjected to stress and strain. By monitoring the strain created by stress loads acting on one or more components of the system, better control over operation of the system is enabled. In the specific example illustrated, system 20 is a well related system, such as a drilling system. However, the system and methodology described herein for measuring strain may be used in a variety of systems, and system 20 simply is provided as an illustrative example.

In FIG. 1, the illustrated embodiment of system 20 comprises a bottom hole assembly 22 which is part of a drill string 24 used to form a desired, directionally drilled wellbore 26. In this example, system 20 also comprises a downhole tool 28, e.g. a rotary steerable system 30 controlled by a valve system and corresponding actuators. The rotary steerable system 30 may include a steering section housing 32 designed to contain valve systems and/or electronics which control the direction of drilling. Additionally, one or more strain measurement systems 34 may be mounted on one or more selected components, such as rotary steerable system 30. In the example illustrated, rotary steerable system 30 is connected with a bit body section 36 having a drill bit 38 rotated by a drill bit shaft 40.

Depending on the environment and the operational parameters of the drilling operation, system 20 may comprise a variety of other features. For example, drill string 24 may include drill collars 42 which, in turn, may be designed to incorporate desired drilling modules, e.g. logging-while-drilling and/or measurement-while-drilling modules 44. Strain measurement systems 34 also may be mounted on the drill collars 42 and/or on other drill string components subjected to strain during a drilling operation.

Various surface systems also may form a part of the illustrated system 20. For example, a drilling rig 46 may be positioned above the wellbore 26 and a drilling fluid system 48, e.g. drilling mud system, may be used in cooperation with the drilling rig 46. The drilling fluid system 48 is positioned to deliver a drilling fluid 50 from a drilling fluid tank 52. The drilling fluid 50 is pumped through appropriate tubing 54 and delivered down through drilling rig 46 and into drill string 24. In many applications, the return flow of drilling fluid flows back up to the surface through an annulus 56 between the drill string 24 and the surrounding wellbore wall. The return flow may be used to remove drill cuttings resulting from operation of drill bit 38. Forces associated with pumping the drilling fluid, drilling the wellbore, increasing temperatures, and other factors create stress on many of the drill string components which can lead to strain measured by the strain measurement system or systems 34.

The system 20 also may comprise other components, such as a surface control system 58. The surface control system 58 may be used to receive and process data from the strain measurement systems 34. According to an embodiment of strain measurement system 34, a strain amplifier mechanism 60, such as a compliant mechanism, is coupled with a strain sensor 62 which relays strain data to control system 58. Additionally, surface control system 58 may be used to receive other signals and to transmit control/power signals downhole. In some embodiments, the surface control system 58 receives and processes data from downhole strain measurement systems 34 and/or other sensor systems to facilitate communication of appropriate commands to the rotary steerable system 30 for controlling the speed and direction of drilling during the formation of wellbore 26.

Figure 2:
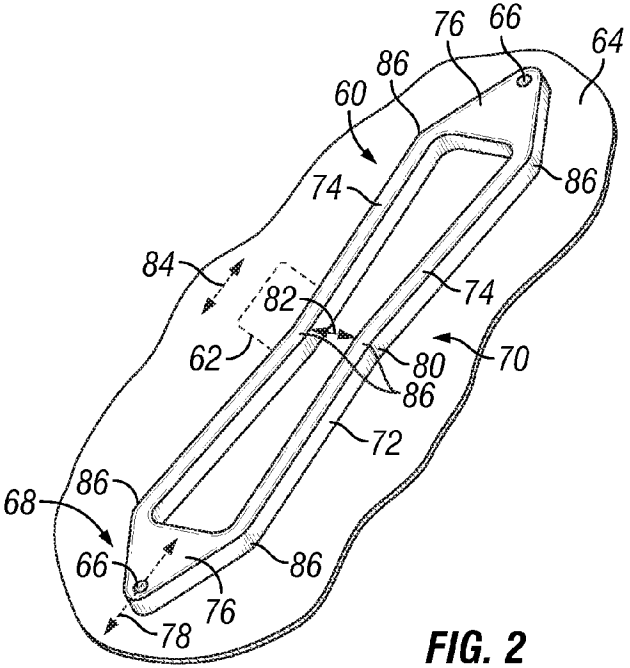
FIG. 2 is an orthogonal view of an embodiment of a strain amplifying mechanism in the form of a compliant mechanism which may be mounted to the component being monitored for strain, according to an embodiment of the present invention.

Referring generally to FIG. 2, an example of strain amplifier 60 is illustrated as mounted on a reference structure/reference component 64, such as tool 28. The illustrated embodiment of strain amplifier 60 is a single input, single output strain amplifier affixed to reference component 64 at two affixation points 66. As the strain amplifier 60 receives an input at an input port 68, a corresponding larger output is caused at an output port or ports 70, and the output is measured by strain sensor 62. The output port 70 moves a greater distance relative to a reference length than the input port 68 moves relative to the same reference length. In the specific embodiment illustrated, the strain amplifier 60 is a compliant mechanism 72. By way of example, compliant mechanism 72 may be a monolithic structure having flex members 74 extending between attachment ends 76. The attachment ends 76 are secured to reference component 64 at affixation points 66.

As the compliant mechanism 72 is compressed in a first direction represented by arrow 78, strain sensor 62 measures output motion at a hinge portion 80 of flex members 74, as represented by arrow 82. The motion of flex members 74 (represented by arrow 82) is substantially larger than the input motion (represented by arrow 78) resulting from strain of reference component 64 in a direction represented by arrow 84. In other words, the output motion is over a substantially greater distance than the input motion caused by strain in reference component 64. In this particular example, the output motion 82 is generally perpendicular to the input motion 78 although the relative directions of input and output motion depend on the design of strain amplifier 60.

The compliant mechanism 72 has live joints 86 which improve the integrity and continuous response of the mechanism even when subjected to very small movements. This characteristic improves the ability to measure strain as compared to, for example, revolute-joint mechanisms which can have a backlash greater than the value of the strain. For purposes of explanation, however, the action of compliant mechanism 72 is represented schematically in FIG. 3 as a slide-revolute mechanism to facilitate understanding of the input and output motions. In this example, the strain amplifier mechanism 60 is at an initial configuration in which the attachment end is at a first position represented by line 88 and the flex members are at a first position represented by lines 90. Under strain, compressive loading acts against the strain amplifier 60 in a direction represented by arrow 92 to compress the attachment end to a second position represented by line 94. This action causes the flex members to flex inwardly at hinge portion 80, as represented by arrows 96, until the flex members are at a new position represented by lines 98. The design of strain amplifier 60 ensures that the output distance represented by arrows 96 is substantially greater than the input distance caused by the compressive loading represented by arrow 92. This greater output distance provides a much improved signal-to-noise ratio and enables more accurate and consistent measurement of strain in reference component 64.

Figure 3:
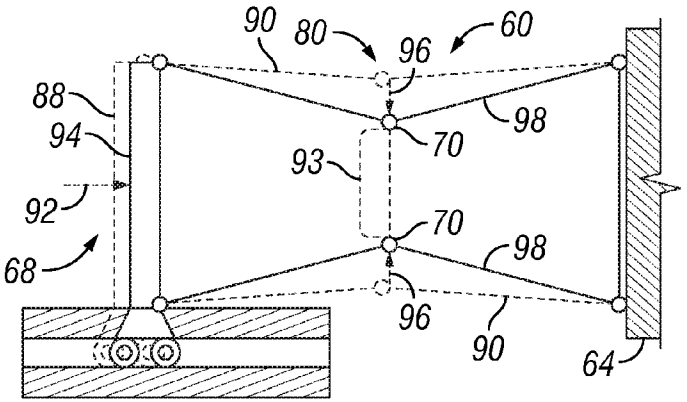
FIG. 3 is a schematic representation of the strain amplifying mechanism illustrated in FIG. 2 which shows the increased movement of an output port in response to the relatively smaller movement of an input port, according to an embodiment of the present invention.

As further illustrated in FIG. 3, several of the strain amplifier embodiments may utilize additional amplification mechanisms 93, as represented by dashed lines. In some embodiments, mechanism 93 comprises another strain amplifying compliant mechanism embedded between output ports 70. The mechanism 93 also may comprise additional mechanisms to further repeat and enhance the amplification. For example, some embodiments comprise a plurality of strain amplifiers 60, 93 which may be cascaded with respect to each other to achieve a desired amplification. Depending on the design of the overall structure, mechanism 93 may comprise cascaded strain amplifiers or links between cascaded amplifiers. In the embodiment illustrated in FIG. 2, for example, additional strain amplifiers 60 may be cascaded and embedded to amplify strains or displacements while changing other mechanical properties of the strain amplifiers, e.g. changing the resonant frequencies or occupied space of the strain amplifiers.

Generally, strain errors are related to the value of the strain induced. In practice, larger strains reduce the environmental errors which can affect measurement of the strain under the same conditions. In other words, physical amplification of the strain occurring in a component reduces the effects of potential errors. By linking compliant mechanism 72 between two points on component 64, the strain in component 64 is input to compliant mechanism 72 through its input port. The design of compliant mechanism 72 causes increased movement at an output port which corresponds mathematically with the lesser movement at the input port. This greater output is more readily measured and reduces the error effect.

Figure 4:
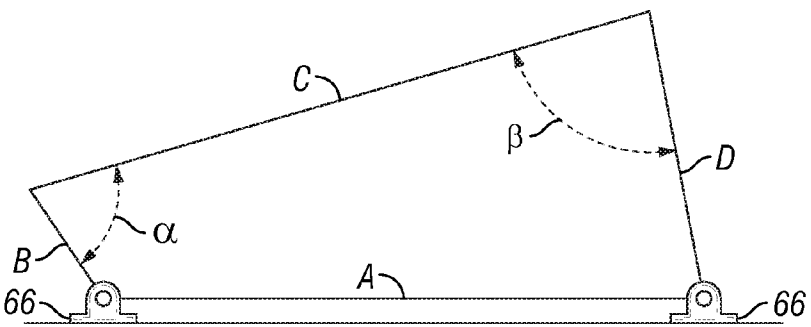
FIG. 4 is a schematic representation of an example of a four bar linkage which can be used to amplify a strain, according to an embodiment of the present invention.

Strain amplifier 60 may have a variety of forms depending on the environment, application, and other design considerations. In many applications, strain amplifier 60 may be constructed as a four-bar mechanism, such as the mechanism represented in FIGS. 4 and 5. In FIG. 4, the four-bar mechanism is illustrated schematically as fixed at points 66 and as having bars a, b, c, d of fixed lengths which provide angles $\alpha$ and $\beta$ between bars b, c and d, c, respectively. The angles and bar lengths may be used to calculate the relationship between an input against bar b and the resulting output at bar d.

Figure 5:
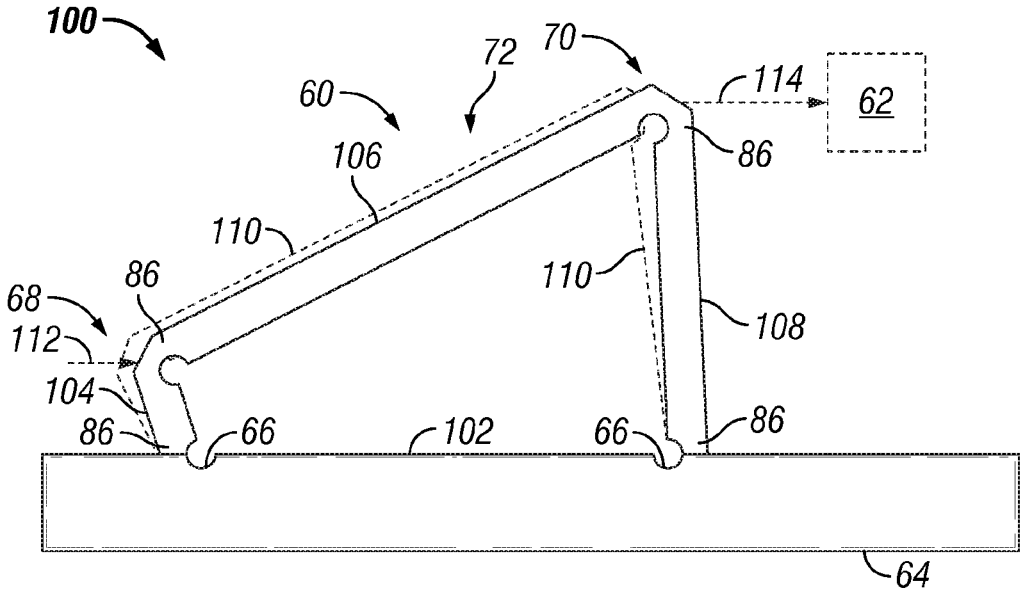
FIG. 5 is another schematic representation of the four bar linkage in which an input port is moved by a strain induced input to cause movement of an output port over a greater distance, according to an embodiment of the present invention.

In FIG. 5, a similar four-bar linkage mechanism 100 is illustrated as having bars 102, 104, 106 and 108 linked by live hinges/joints 86 to form compliant mechanism 72. The live joints 86 may only allow compliant mechanism 72 to "rotate" through a specific angle before reaching the elastic limit of the material but this is generally not a concern because the strains are relatively small displacement. An example of the relatively small displacement caused by strain is provided by the outline/wireframe 110 which represents the original position of the compliant mechanism 72 prior to experiencing a strain input at input port 68, as represented by arrow 112. The input causes a substantially greater output at output port 70, as represented by arrow 114. In many applications, the compliant mechanism 72 may be designed such that the distance moved at output port 70 is nearly twice (or even greater) the distance moved at input port 68 as a result of strain in component 64.

Figure 6:
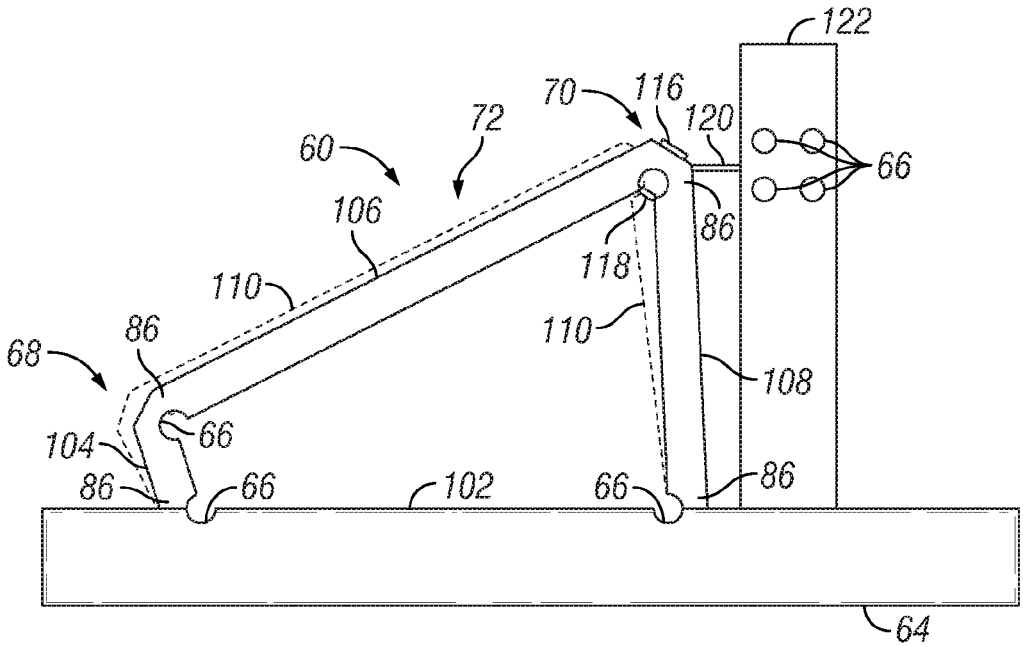
FIG. 6 is another schematic representation of the four bar linkage in which sensors have been coupled with the four bar linkage at various locations, according to an embodiment of the present invention.

Referring generally to FIG. 6, the output movement (and thus the strain) can be measured by a variety of sensors positioned in several locations. By way of example, a strain sensor 116 may be mounted directly on the compliant mechanism 72 at one of the live joints 86 to detect the flexing. In another embodiment, a strain sensor 118 may be mounted between elements of the compliant mechanism 72, e.g. between flex members 74 or between bars of the four-bar mechanism 100 as illustrated in FIG. 6. In another embodiment, a strain sensor 120 may be connected between anchor points on the compliant mechanism 72 and a stationary structure 122 (e.g. a portion of component 64). The strain sensors 116, 118 and 120 are versions of strain sensor 62 and may be used individually or in cooperation to measure the output movement of compliant mechanism 72 which results from strain in reference component 64.

In FIG. 6, schematic circular elements are used to represent the fixture points 66 at which the compliant mechanism 72 is affixed to the reference component 64. In the example illustrated, the output displacement at output port 70 is only about two times the input displacement at input port 68, however the strain amplification is around 15,000 times. The reason for the substantial strain amplification is the short distance between anchor points 66. Accordingly, some applications employ materials to form compliant mechanism 72 which are more elastic than the material of reference component 64 to ensure the material of the compliant mechanism does not reach its elastic limit.

In one construction of the compliant mechanism 72 illustrated in FIGS. 5 and 6, the input distance represented by arrow 112 is 0.58 mm and the output distance represented by arrow 114 is 1.00 mm but the strain amplification is over 15,000 times. It should be noted that the values provided are merely for explanation, and the actual values of input distance, output distance, and strain amplification may vary substantially depending on the design of compliant mechanism 72. In the particular example illustrated, the strain calculation at the input port 68 and the output port 70 may be calculated according to the following equations:

$$\epsilon_{in}=\Delta L_{in}/L_{in}=0.58\text{ mm}/317.6\text{ mm}=1.826\text{ mm/m};$$

$$\epsilon_{out}=\Delta L_{out}/L_{out}=1.00\text{ mm}/36.46\text{ mm}=27.43\text{ mm/m};$$

and $$\epsilon_{out}/\epsilon_{in}=15018.8,\text{ where:}$$

$\Delta L_{in}$=Reference Deformation (due to loading)
$\Delta L_{out}$=Compliant Translation
$L_{in}$=Sustaining Length (the loaded body)
$L_{out}$=Transformed Length
$\epsilon_{out}$=Output Strain=$\Delta L_{out}/L_{out}$
$\epsilon_{in}$=Actual Strain=$\Delta L_{in}/L_{in}$
D=Deformation Gain=$\Delta L_{out}/\Delta L_{in}$
E=$\epsilon_{out}/\epsilon_{in}$=Strain Gain=$(\Delta L_{out}\Delta L_{in})/(L_{out}\times\Delta L_{in})=D\times L_{in}/L_{out}$ Because of the large mechanical amplification of strain, a variety of sensors and measurement technologies may be employed to measure and monitor strain in many types of components 64. For example, differential variable reluctance transducers (DVRTs) may be employed to detect and monitor strain.

Figure 7:
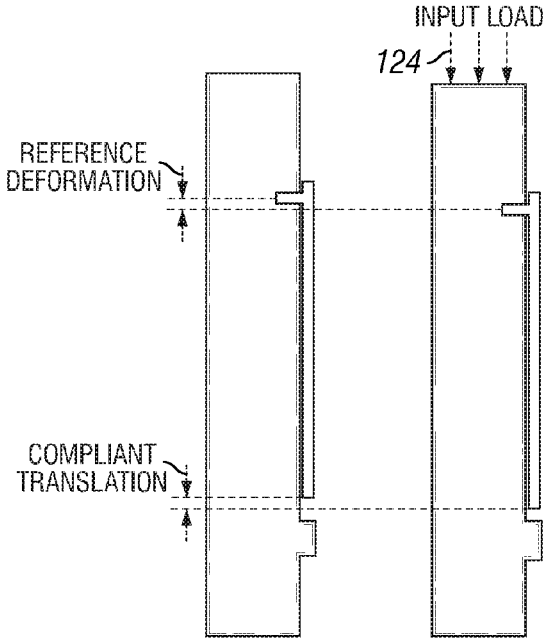
FIG. 7 is a schematic representation of an embodiment of a mechanism which amplifies a strain by reducing a reference length, according to an embodiment of the present invention.

Referring generally to FIG. 7, a schematic example is provided of another type of strain amplifier 60 which demonstrates a pure translation approach. In this example, the strain gain E is equal to $L_{in}/L_{out}$ and amplification is achieved without compliant mechanisms. In practice, a goal would be to maximize deformation gain D and the ratio $L_{in}/L_{out}$. Upon placement of an input load, as represented by arrows 124, input and output displacements are equal but the strain gain is enlarged because the transformed length ($L_{out}$) is shorter than the sustaining length ($L_{in}$).

Figure 8:
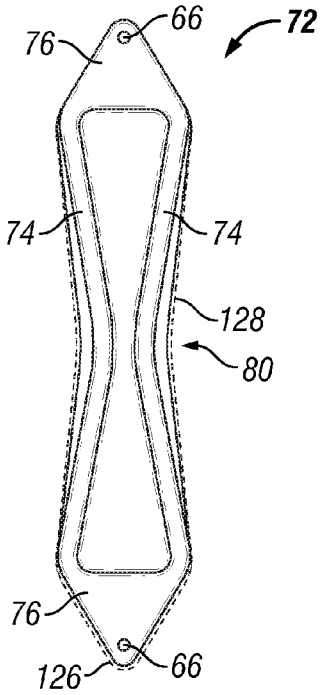
FIG. 8 is a representation of a strain amplifying mechanism having flexible members which move a greater distance in a first direction when the mechanism is subjected to strain the induced movement in another direction, according to an embodiment of the present invention.

Another specific example may be explained with reference to FIG. 8 which provides a schematic illustration of compliant mechanism 72 generally in the form described above in FIG. 2. In this example, the compliant mechanism 72 is attached at points 66 to reference component 64 and the amplified strain is measured at hinge portion 80 in a generally horizontal direction with respect to FIG. 8. For the purpose of this example, the upper fixture point may be considered stationery, and the lower reference point 66 is translated upwardly due to compression of the compliant mechanism 72 when component 64 is subjected to strain.

To facilitate an understanding of the function of compliant mechanism 72, actual values are used in the following example but these values are merely examples and the input motions and output motions may vary substantially depending on the size, materials, and configuration of compliant mechanism 72. In this specific example, the lower end of compliant mechanism 72 and its lower fixture point 66 is translated upwardly a deformation distance of 0.04 mm from its original position represented by outline/wireframe 126. Due to this input deformation, an output deformation of 0.094 mm is experienced at the hinge portion 80 of each flex member 74 relative to its original position represented by outline/wireframe 128. The node or live hinge joint 86 of each flex member 74 moves 0.094 mm resulting in a total deformation of 0.184 mm. Consequently, the deformation gain D is equal to 0.184/0.04 or 4.6. The physically amplified strain substantially reduces the signal-to-noise ratio and substantially improves the ability to measure and monitor strain in the corresponding component 64.

In many applications and environments, the compliant mechanism 72 (or other type of strain amplifier 60) may be subjected to substantial vibration. In wellbore drilling applications, for example, drill collars and other components that may be subjected to strain can experience substantial vibration. Generally, the range of vibration should not exceed the lowest resonant frequency of the compliant mechanism 72. A modal analysis may be run to determine an appropriate operational bandwidth of the strain amplifier 60. Once the resonant frequency is determined to be a certain value, then measurements close to this frequency may be avoided. It should be noted the resonant frequency has nothing to do with the sampling frequency of the strain sensor 62, which can be as high as required to reconstruct the signal. Sometimes the resonant frequency can be adjusted by, for example, increasing the face width of the flexural elements (e.g. flex members 74) to shift to the resonant frequency upwardly and thereby increase the operating range.

Figure 9:
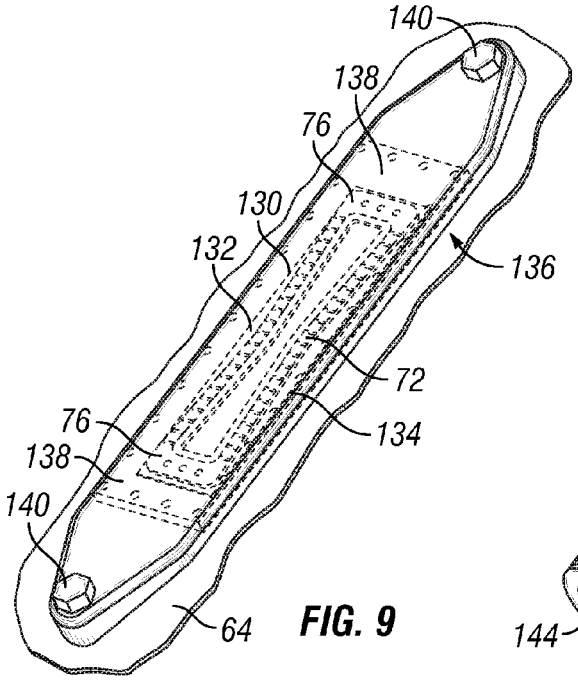
FIG. 9 is an illustration of an alternate example of a strain amplifying mechanism which is dampened against resonant oscillation, according to an embodiment of the present invention.

The problem associated with resonant frequency also may be reduced or eliminated by increasing the dampening of the strain amplification system. For example, a dampening element 130 may be used in cooperation with the compliant mechanism 72 to prevent resonant oscillation, although the dampening mechanism may cause slower system response. In the embodiment illustrated in FIG. 9, dampening element 130 comprises a liquid 132, e.g. oil, placed in a vented chamber 134 of a packaged load cell 136. The liquid 132 serves to dampen compliant mechanism 72 and thus prevent unwanted resonant oscillation of the compliant mechanism. In this example, each attachment end 76 of compliant mechanism 72 is affixed to a corresponding attachment portion 138 of load cell 136. The load cell 136 is securely attached to the reference component 64 at two points via suitable fasteners 140, such as bolts or weldments.

Figure 10:
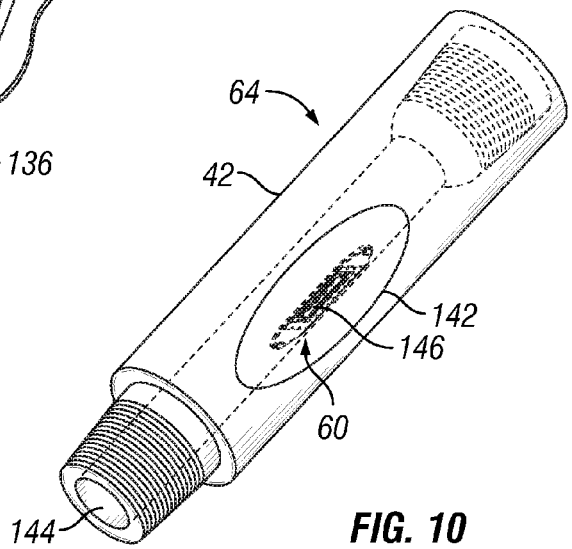
FIG. 10 is an orthogonal view of a strain amplifying mechanism mounted inside a corresponding component, such as a drilling collar, according to an embodiment of the present invention.

Referring generally to FIG. 10, reference component 64 may comprise one or more of the drill collars 42, rotary steerable system 30, or another suitable drill string component. In the embodiment illustrated, the strain amplifier 60 is shown in phantom within bubble 142 which represents positioning of the strain amplifier 60 within the drill collar 42. For example, the compliant mechanism 72 may be mounted along an internal flow passage 144 of the drill collar 42. Other associated components, such as strain sensor 62 and corresponding electronics 146 also may be mounted at this interior position. In some applications, the components may be combined into a packaged load cell similar to packaged load cell 136 and appropriately mounted within the drill collar or other component 64.

Figure 11:
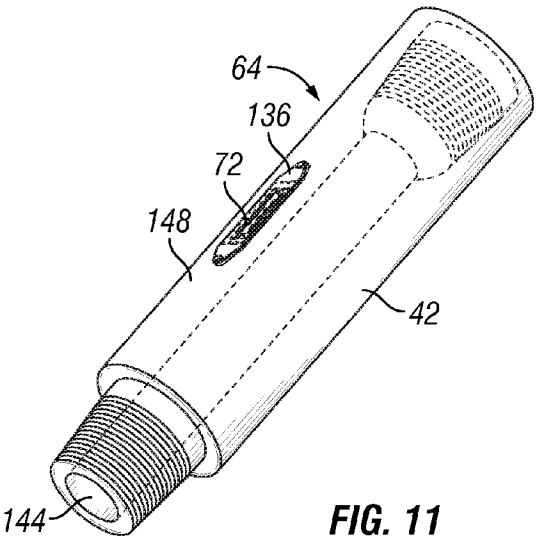
FIG. 11 is an orthogonal view of a strain amplifying mechanism mounted on an exterior of a corresponding component, such as a drilling collar, according to an embodiment of the present invention.

An alternate embodiment is illustrated in FIG. 11 in which the strain amplifier 60 is mounted along an external surface 148 of drill collar 42. In this example, strain amplifier 60 also may be constructed in a variety of forms. However, one embodiment employs compliant mechanism 72 mounted within the packaged load cell 136, similar to the packaged load cell illustrated in FIG. 9. Strain experienced by the drill collar 42 acts on the load cell 136 and thus on the compliant mechanism 72 to create the amplified strain movement as described above.

Figure 12:
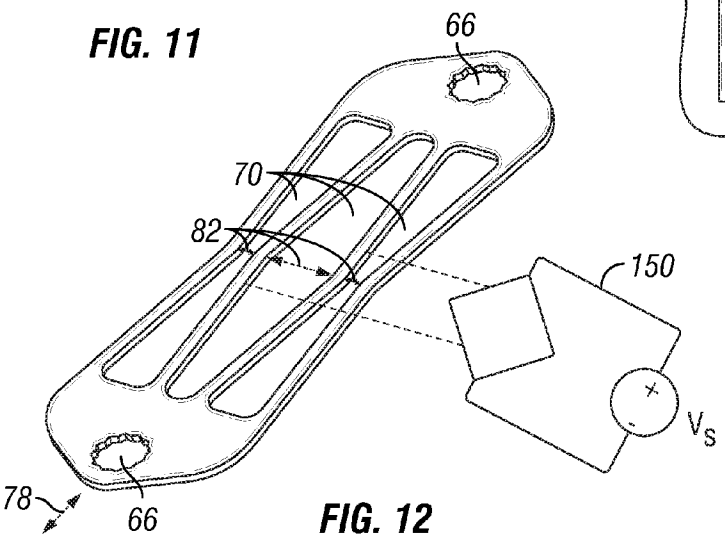
FIG. 12 is an illustration of an alternate example of a strain amplifying mechanism which has multiple output ports used on a Wheatstone bridge, according to an embodiment of the present invention.

Depending on the parameters of a given application and/or environment, strain amplifier 60 may be constructed with various types of compliant mechanisms 72. In one alternate embodiment, the compliant mechanism 72 incorporates a plurality of output ports 70 which can be coupled to one or more strain sensors 62. For example, the plurality of output ports 70 may be used in corresponding arms of a Wheatstone bridge 150, as illustrated in FIG. 12. In the specific example illustrated, the output ports 70 are formed by corresponding hinge portions 80 of a plurality of pairs of flex members 74 extending between attachment ends 76. The amplified output represented by arrows 82 may be detected by the Wheatstone bridge 150 or by other appropriate strain sensors able to detect movement between flex members 74 when compliant mechanism 72 is subjected to a strain induced input 78 which changes the distance between points 66. The amplified motion occurs at the hinge portion 80 of flex member pairs and between flex members of adjacent pairs, as indicated by the arrows 82.

Figure 13:
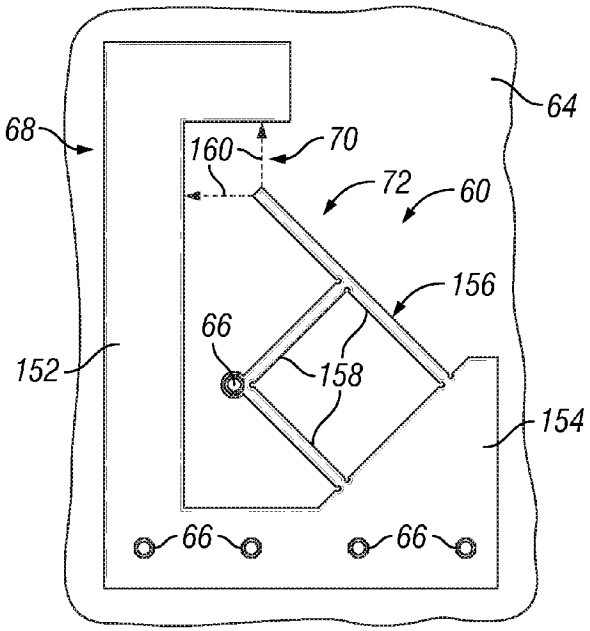
FIG. 13 is an illustration of another alternate example of a strain amplifying mechanism, according to an embodiment of the present invention.

In another embodiment, the compliant mechanism 72 is constructed as a pantograph 152, as illustrated in FIG. 13. In this embodiment, compliant mechanism 72 (pantograph 152) is affixed to the corresponding component 64 at a plurality of the points 66 via, for example, welding, bolting, or other type of affixation technique. By way of example, the affixed points 66 may comprise plural, e.g. four, affixed points securing a frame structure 154 of the pantograph 152 to component 64. The affixed points 66 also comprise an additional fixed point securing a multi-bar linkage mechanism 156 to component 64. The embodiment illustrated in FIG. 13, similar to several other embodiments described above, may be fabricated as a micro-electromechanical system (MEMS) affixed at two points which serve as the input port, e.g. input port 68. The MEMS device may be mounted on the corresponding component 64 by, for example, welding or bolting. Additionally, the MEMS device may be hermetically sealed.

The multi-bar linkage mechanism 156 comprises a plurality of bars 158 coupled to each other at hinges, such as live joints 86. The multi-bar linkage 156 also is flexibly connected to frame structure 154, as illustrated. The input port 68 may effectively input strain from component 64 in a variety of directions, and the output port 70 is between multi-bar linkage mechanism 156 and the frame structure 154. The amplified strain is detected at output port 70 by relative movement of an extended bar of the multi-bar linkage 156 relative to the frame structure 154, as indicated by arrows 160. Accordingly, the output ports 70 may be used for multiple outputs in different directions, e.g. shear strains and axial strains. In this example, various types of sensors and/or multiple sensors may be mounted between the multi-bar linkage mechanism 156 and frame structure 154 at, for example, the positions of arrows 160 to isolate the two axes of measurements.

As described herein, strain amplifier 60 may be adapted for use in a variety of environments and with many types of corresponding components. Additionally, the specific size, materials and configuration of the compliant mechanism 72 may vary from one application to another. In determining the type of strain amplifier 60/compliant mechanism 72 to employ in a given application, an initial analysis may be performed. Several types of analyses are useful in determining the type and design of compliant mechanism 72.

According to one approach for selecting an appropriate strain amplifier 60/compliant mechanism 72, the inputs to compliant mechanism 72 resulting from strain of component 64 are initially modeled in terms of value and deformation type. Subsequently, a target for measurable output strain is set. This allows the compliant mechanism 72 to be designed with sufficiently accurate deformation gain D (may be dictated by the manufacturing process). The fixed ports are then set for the input and, if needed, for the output so the output strain can be calculated.

Subsequently, a finite element analysis may be performed to ensure integrity of the compliant mechanism and to evaluate fatigue criteria. A modal analysis also may be run to ensure adequate bandwidth and to determine whether it is desirable to introduce damping or to change aspect ratios of the compliant mechanism elements. Thermal analysis also may be performed in cases where the compliant mechanism 72 is designed for temperature compensation. For example, if the compliant mechanism 72 is made of a material which expands more than the base material of component 64, thermal analysis can be used to appropriately calibrate, adjust or modify the compliant mechanism.

Various techniques may be employed to select/design a suitable mechanism for measuring strain and/or displacement. In one general approach, the measurement requirements (e.g. resolution, accuracy, bandwidth) are initially examined. The loading profile (e.g. range, loads) is then determined along with environmental conditions (e.g. vibration, temperature, pressure). Based on this initial analysis, a strain/displacement sensor is selected and paired with suitable amplification mechanism or mechanisms 60. The sensor and amplification mechanism are then tested to determine the acceptability of various system parameters and/or the effects of environmental conditions. Such parameters may include response, durability and vibration. The sensor and amplification system also may be calibrated to accommodate for additional parameters, such as temperature, pressure, and resonance. If the testing is successful, the sensor and amplification system may be implemented in a given application; otherwise an alternate sensor is selected and again tested.

The system for physically/mechanically amplifying measured strain may be designed in several configurations assisting measurement of strain in many types of components. The materials employed are selected according to the environment, application, and environmental factors to which the component undergoing strain is subjected. Additionally, the compliant mechanism may have several forms with various flexible members connected by live joints or other types of joints to enable creation of a substantially larger output deformation based on a smaller input deformation resulting from strain of a corresponding component. The larger output deformation may be measured by one or more sensors of a variety of types and styles. Furthermore, the strain data may be transmitted to one or more processing systems designed to process, analyze and output data helpful in evaluating the strain and effects of the strain on one or more components utilized in a given application. Also, a variety of cables, communication lines, wired drill pipe, wireless techniques, and other transmission techniques may be used to transmit the strain data uphole to the processing system.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system, comprising:

a drilling component coupled to a drill string deployed to drill a wellbore;

a compliant mechanism mounted to the drilling component and comprising:

an input port directly linked to the drilling component to move when the drilling component undergoes a strain, wherein the input port comprises a plurality of points that includes:

a plurality of first points at which a frame structure of the compliant mechanism is affixed to the drilling component; and a second point at which a multi-bar linkage mechanism of the compliant mechanism is affixed to the drilling component; and an output port operable to move a greater distance relative to a reference length than the input port in response to movement of the input port relative to the same reference length; and a sensor coupled to the output port to detect movement of the output port and thus the strain.

2. The system of claim 1 wherein the compliant mechanism is constructed as a pantograph comprising the frame structure and the multi-bar linkage mechanism.

3. The system of claim 2 wherein the pantograph is a micro-electromechanical system (MEMS) device.

4. The system of claim 3 wherein the MEMS device is hermetically sealed.

5. The system of claim 1 wherein the multi-bar linkage mechanism comprises a plurality of bars coupled to each other via a plurality of hinges.

6. The system of claim 5 wherein at least one of the plurality of hinges comprises a live joint.

7. The system of claim 1 wherein the multi-bar linkage mechanism is flexibly connected to the frame structure.

8. The system of claim 1 wherein the input port inputs strain from the drilling component in a plurality of different directions.

9. The system of claim 1 wherein the output port is disposed between multi-bar linkage mechanism and the frame structure.

10. The system of claim 9 wherein the amplified strain is detected at the output port by relative movement of an extended bar of the multi-bar linkage mechanism relative to the frame structure.

11. The system of claim 10 wherein the output port is operable as multiple outputs in a plurality of different directions.

12. The system of claim 1 wherein the drilling component is a drill collar.

13. A method, comprising:

coupling a drilling component to a drill string deployed to drill a wellbore, wherein a compliant mechanism mounted to the drilling component comprises:

an input port directly linked to the drilling component to move when the drilling component undergoes a strain, wherein the input port comprises a plurality of points that includes:

a plurality of first points at which a frame structure of the compliant mechanism is affixed to the drilling component; and a second point at which a multi-bar linkage mechanism of the compliant mechanism is affixed to the drilling component; and an output port operable to move a greater distance relative to a reference length than the input port in response to movement of the input port relative to the same reference length; and operating a sensor coupled to the output port to detect movement of the output port and thus the strain.

14. The method of claim 13 wherein:

the compliant mechanism is constructed as a pantograph comprising the frame structure and the multi-bar linkage mechanism;

the pantograph is a micro-electromechanical system (MEMS) device; and the MEMS device is hermetically sealed.

15. The method of claim 13 wherein:

the multi-bar linkage mechanism comprises a plurality of bars coupled to each other via a plurality of hinges; and at least one of the plurality of hinges comprises a live joint.

16. The method of claim 13 wherein:

the multi-bar linkage mechanism is flexibly connected to the frame structure;

the input port inputs strain from the drilling component in a plurality of different directions;

the output port is disposed between multi-bar linkage mechanism and the frame structure;

the amplified strain is detected at the output port by relative movement of an extended bar of the multi-bar linkage mechanism relative to the frame structure; and the output port is operable as multiple outputs in a plurality of different directions.

17. The method of claim 13 wherein the drilling component is a drill collar.

18. The method of claim 13 wherein:

the compliant mechanism is constructed as a pantograph comprising the frame structure and the multi-bar linkage mechanism;

the pantograph is a micro-electromechanical system (MEMS) device;

the MEMS device is hermetically sealed;

the multi-bar linkage mechanism comprises a plurality of bars coupled to each other via a plurality of hinges;

at least one of the plurality of hinges comprises a live joint;

the multi-bar linkage mechanism is flexibly connected to the frame structure;

the input port inputs strain from the drilling component in a plurality of different directions;

the output port is disposed between multi-bar linkage mechanism and the frame structure;

the amplified strain is detected at the output port by relative movement of an extended bar of the multi-bar linkage mechanism relative to the frame structure;

the output port is operable as multiple outputs in a plurality of different directions; and the drilling component is a drill collar.

19. A system, comprising:

a drilling component coupled to a drill string deployed to drill a wellbore, wherein the drilling component comprises a drill collar;

a compliant mechanism constructed as a pantograph having a frame structure and a multi-bar linkage mechanism flexibly connected to the frame structure, wherein the compliant mechanism comprises:

an input port comprising:

a plurality of first points at which the frame structure is affixed to the drill collar; and a second point at which the multi-bar linkage mechanism is affixed to the drill collar; and an output port comprising an extended bar of the multi-bar linkage mechanism operable to move relative to the frame structure, including to move a greater distance than at least one of the first and second points of the input port in response to strain-induced movement of the at least one of the first and second points of the input port; and a sensor operable to detect movement of the extended bar relative to the frame structure and thus the strain inducing movement of the at least one of the first and second points of the input port, wherein:

the pantograph is a hermetically sealed micro-electro-mechanical system device;

the multi-bar linkage mechanism comprises a plurality of bars coupled together via a plurality of hinges each formed by a live joint;

the strain inducing movement of the at least one of the first and second points of the input port is in a plurality of different directions; and the output port is operable as multiple outputs in a plurality of different directions.

* * * * *